US009505990B2

(12) United States Patent
Sams et al.

(10) Patent No.: US 9,505,990 B2
(45) Date of Patent: Nov. 29, 2016

(54) SYSTEM AND METHOD OF DELIVERING DILUTION WATER DROPLETS WITHIN AN OIL-AND-WATER STREAM

(71) Applicant: Cameron Solutions, Inc., Houston, TX (US)

(72) Inventors: Gary W Sams, Spring, TX (US); Joseph Min-Hsiun Lee, Houston, TX (US)

(73) Assignee: Cameron Solutions, Inc., Houston, TX (US)

( * ) Notice: Subject to any disclaimer, the term of this patent is extended or adjusted under 35 U.S.C. 154(b) by 345 days.

(21) Appl. No.: 14/256,647

(22) Filed: Apr. 18, 2014

(65) Prior Publication Data

US 2015/0299581 A1 Oct. 22, 2015

(51) Int. Cl.

| | |
|---|---|
| ***C10G 31/08*** | (2006.01) |
| ***B01F 3/08*** | (2006.01) |
| ***B01F 3/10*** | (2006.01) |
| ***B01F 5/20*** | (2006.01) |
| ***C10G 21/30*** | (2006.01) |
| ***B01F 5/04*** | (2006.01) |

(52) U.S. Cl.

CPC ..... *C10G 31/08* (2013.01); *B01F 3/0807* (2013.01); *B01F 3/0865* (2013.01); *B01F 5/0456* (2013.01); *B01F 5/0463* (2013.01); *B01F 5/0466* (2013.01); *C10G 21/30* (2013.01); *C10G 2300/4056* (2013.01)

(58) Field of Classification Search

CPC .. B01F 3/0807; B01F 3/0865; B01F 5/0456; B01F 5/0463; B01F 5/0466; C10G 21/30; C10G 2300/4056; C10G 31/06; C10G 31/08

See application file for complete search history.

(56) References Cited

U.S. PATENT DOCUMENTS 8,790,509 B2 * 7/2014 Vu ..... C10G 31/06 196/46

2008/0192566 A1 8/2008 Yamashita

FOREIGN PATENT DOCUMENTS

EP 1586620 A1 10/2005

FR 2286694 A1 4/1976

* cited by examiner

*Primary Examiner* — Renee E Robinson

*Assistant Examiner* — Derek Mueller

(74) *Attorney, Agent, or Firm* — Gable Gotwals

(57) ABSTRACT

A system for desalting a crude oil stream includes an elongated, vertically oriented vessel that has an interior piping structure arranged concentric to the vessel. The piping structure, which may have more than one level, has a plurality of spray nozzles oriented at a downward angle for atomizing wash water into a downward flowing crude oil stream. The spray nozzles may be located on a same side or opposite sides of the piping structure. Where multiple levels are used, the number of spray nozzles on each level may be the same as or different than the number of spray nozzles on other levels. The pressure drop through each spray nozzle is preferably no greater than 300 psi and the nozzles preferably deliver a dilution water droplet preferably no larger than 300 microns in diameter. A mixing valve, static mixer, or both can be placed downstream of the vessel.

15 Claims, 7 Drawing Sheets

SYSTEM AND METHOD OF DELIVERING DILUTION WATER DROPLETS WITHIN AN OIL-AND-WATER STREAM

BACKGROUND OF THE INVENTION

This invention generally relates to apparatuses, systems and methods used in crude oil desalting processes and, more specifically, to systems and methods used to inject dilution water into a crude oil stream in order to contact and coalesce entrained water within the stream.

The crude oil desalting process involves washing a crude oil stream with water having a low salt content (e.g. typically about 250 ppm or less) followed by electrostatic dehydration of the resulting mixture. The washing step involves mixing the low salt-content ("fresh" or "dilution") water with the crude oil stream so as to add energy into the stream and coalesce the dilution water with the brine water already entrained in the crude oil stream.

Mixing is accomplished through a mixing valve, static mixer, or some combination of the two. The degree of emulsification of the dilution water primarily depends on the pressure drop imparted by the valve. A normal design range for this pressure drop is in a range of 5 to 25 psi, with most valves or mixers operating below 15 psi. If too large of a pressure drop is created, the water droplets decrease to a size which makes them difficult to coalesce and remove in the downstream electrostatic dehydration process. A pressure drop control system, like that shown in FIG. 1, is used to control and operate the drop within the critical range.

Prior to the crude oil stream entering the mixing valve, it is advantageous to disperse the dilution water in the oil phase. This is typically done by way of a disperser which uses medium pressure spraying of the dilution water through holes on the dispersing tube of the disperser at a rate of 3-10% of oil flow rate. The spraying occurs in a direction perpendicular to the flow of the crude oil stream (see FIGS. 2A & B). Use of a static in-line mixer has also proved beneficial in accomplishing this dispersion.

One problem with the prior art dispersion system and method is, the dilution water droplets being sprayed or dispersed into the crude oil stream are greater than 1000 microns in size. In the invention described below, spray nozzles atomize wash water into the crude oil stream. The atomized water droplets are in a size range of 10 to 300 microns. This smaller wash water droplet size works to increase the contact efficiency with the brine droplets contained in the crude oil stream, thereby increasing desalting performance.

SUMMARY OF THE INVENTION

A system, method, and apparatus for desalting a crude oil stream includes an elongated, vertically oriented vessel that has an interior, piping structure arranged concentric to the vessel. The piping structure—which can be ring-shaped, cross-bar shaped, or any other shape preferable—has a plurality of spray nozzles oriented at a downward angle and receives wash water from a wash water inlet of the vessel. The piping structure may include more than one level of piping, and each level of piping may be fed by its own wash water inlet.

The spray nozzles may be located on different sides of the piping structure and, when more than one level is used, each level may have a different number of spray nozzles than the other levels. The spacing of the spray nozzles does not have to be even within or between levels and, if located on different sides of the piping structure, the nozzles do not have to be placed exactly opposite one another.

The pressure drop through each spray nozzle is preferably no greater than 300 psi and the nozzles preferably deliver a dilution water droplet preferably no larger than 300 microns in diameter.

An objective of this invention is to improve desalting performance by increasing the contact efficiency of the wash water with the brine droplets contained in the crude oil stream. Contact efficiency can be further increased by placing a mixing valve, static mixer, or some combination of the two downstream of the vessel.

ELEMENTS AND NUMBERING USED IN THE DRAWINGS AND DETAILED DESCRIPTION

Figure 2B:
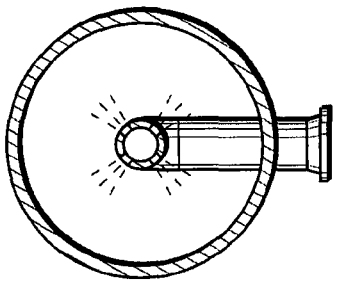
Fig. 2B (PRIOR ART)
FIG. 2B is a view taken along section line 2B of FIG. 2A.
Figure 1:
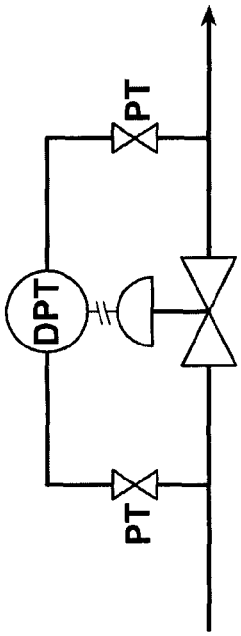
Fig. 1 (PRIOR ART)
FIG. 1 is a schematic of a prior art pressure drop control system.
Figure 2A:
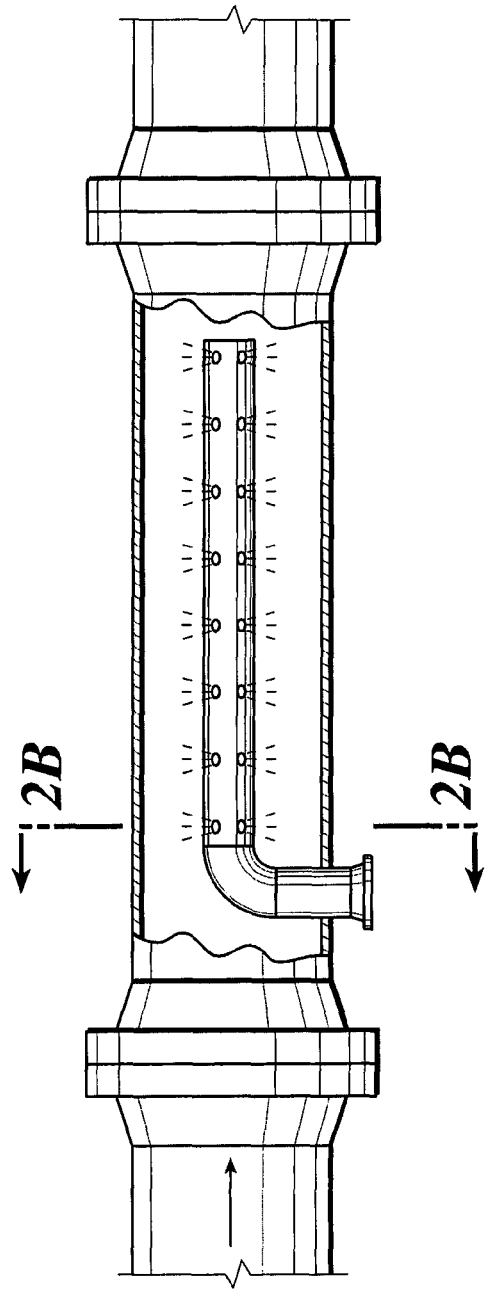
Fig. 2A (PRIOR ART)
FIG. 2A is a cross section view of a prior art mixing injector.

5 Example of a commercial system
10 Mixing vessel
11 Spray nozzle
13 Centerline of 15
15 Spray pattern
17 Longitudinal centerline of 10
19 Inlet pipe
20 Nozzle spool
21 Spray nozzles
23 Wash water inlet
25 Wash water sub-stream
27 Wash water sub-stream
29 Wash water sub-stream
33 Flow meter
35 Wash water sub-inlet
37 Wash water sub-inlet
39 Wash water sub-inlet
45 Vertical pipe connected to 35
47 Vertical pipe connected to 37
49 Vertical pipe connected to 39
55 First or top level connected to 45
57 Second or middle level connected to 47
59 Third or bottom level connected to 49
61 Inner pipe or nozzle ring
63 Outer pipe or nozzle ring
65 Lateral pipe
67 Central longitudinal pipe
71 Spraying head or manifold

81 Crude oil inlet
83 Mixture outlet
83 Flow meter for 25
85 Flow meter for 27
87 Flow meter for 29
89 Flow meter
95 Valve for 25
91 Valve for 27
95 Valve for 29
103 Static mixer
105 Mixing valve
F Flow of oil-and-water stream in 10
P Positive displacement or centrifugal pump
S Interior space of 10

DETAILED DESCRIPTION OF THE PREFERRED EMBODIMENTS

Figure 3A:
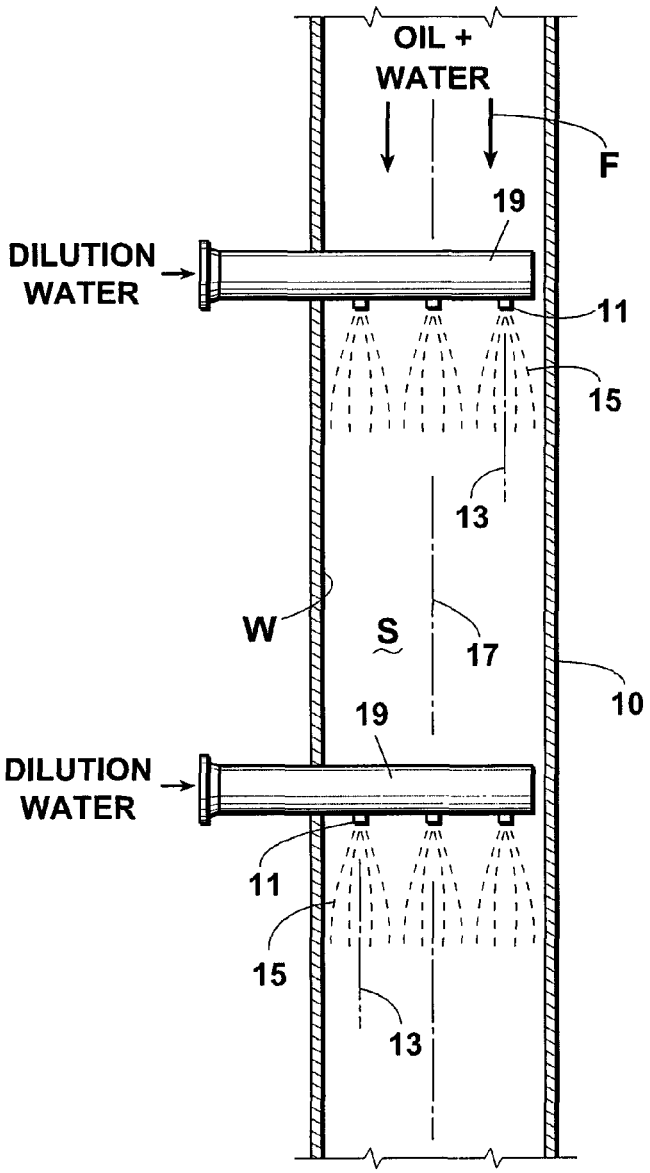
FIG. 3A is a preferred embodiment of a mixing vessel made according to this invention.
Figure 3B:
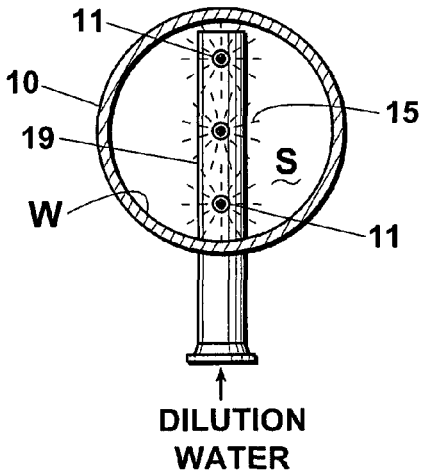
FIG. 3B is a view taken along section line 3B of FIG. 3A.
Figure 5:
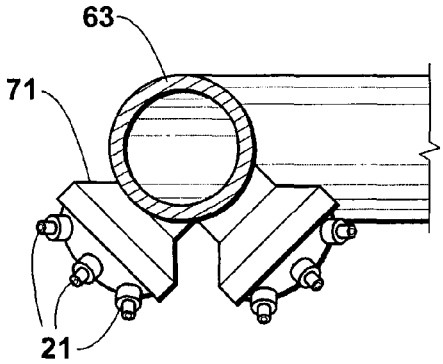
FIG. 5 is a view of the nozzle spool taken along section line 5-5 of FIG. 4.
Figure 4:
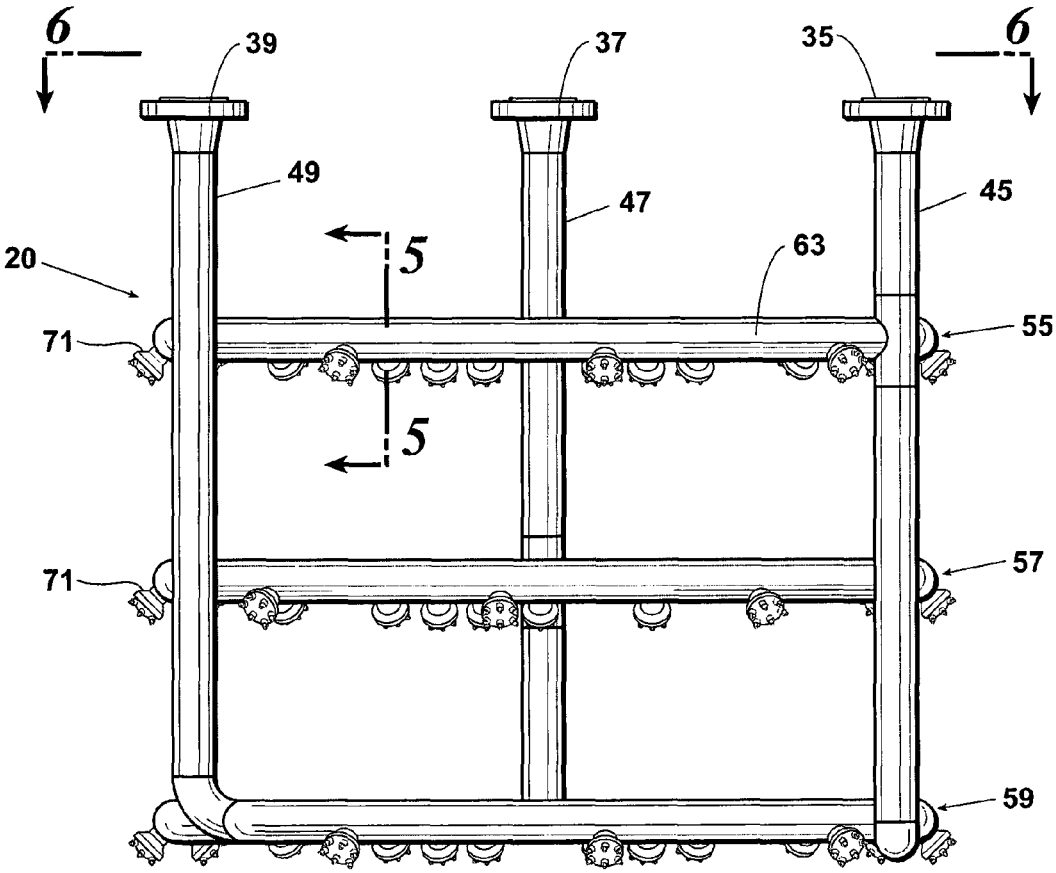
FIG. 4 is a front elevation view of a preferred embodiment of a nozzle spool made according to this invention.
Figure 6:
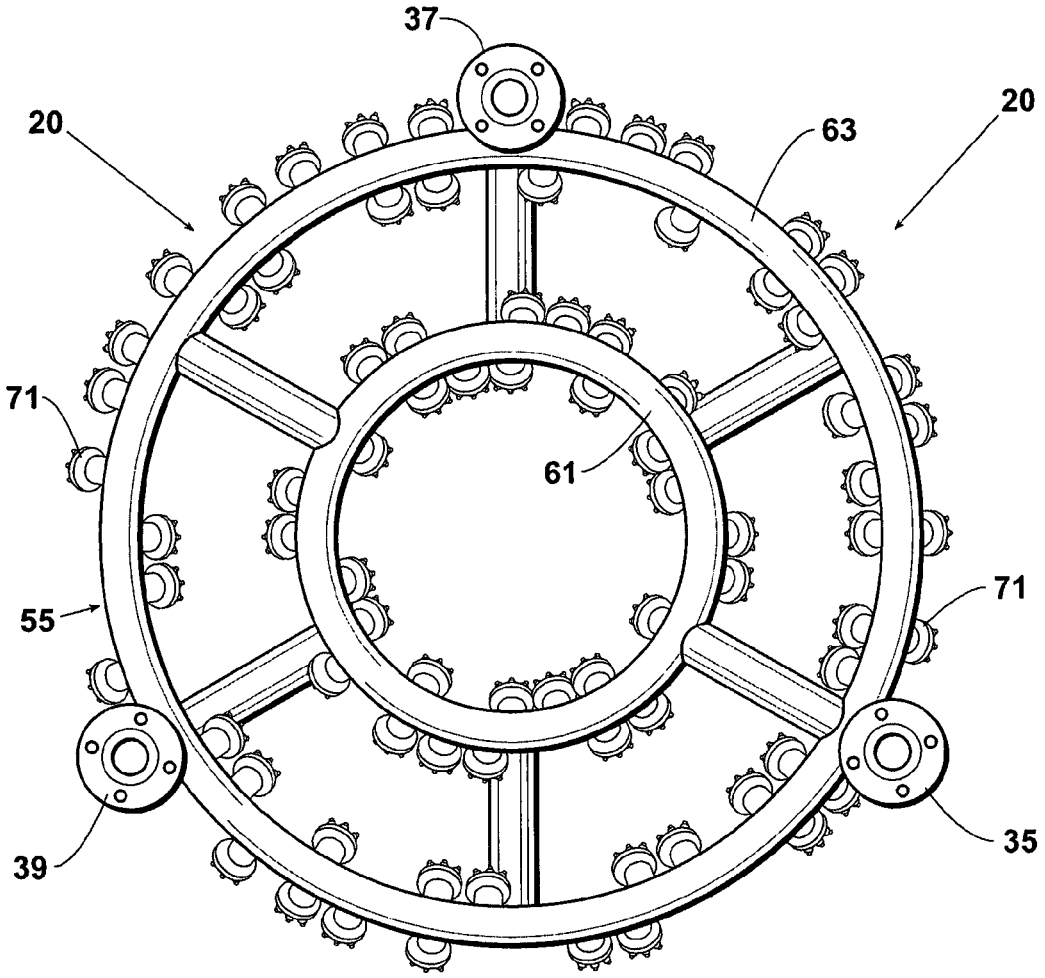
FIG. 6 is a top view of the nozzle spool of FIG. 4.
Figure 7:
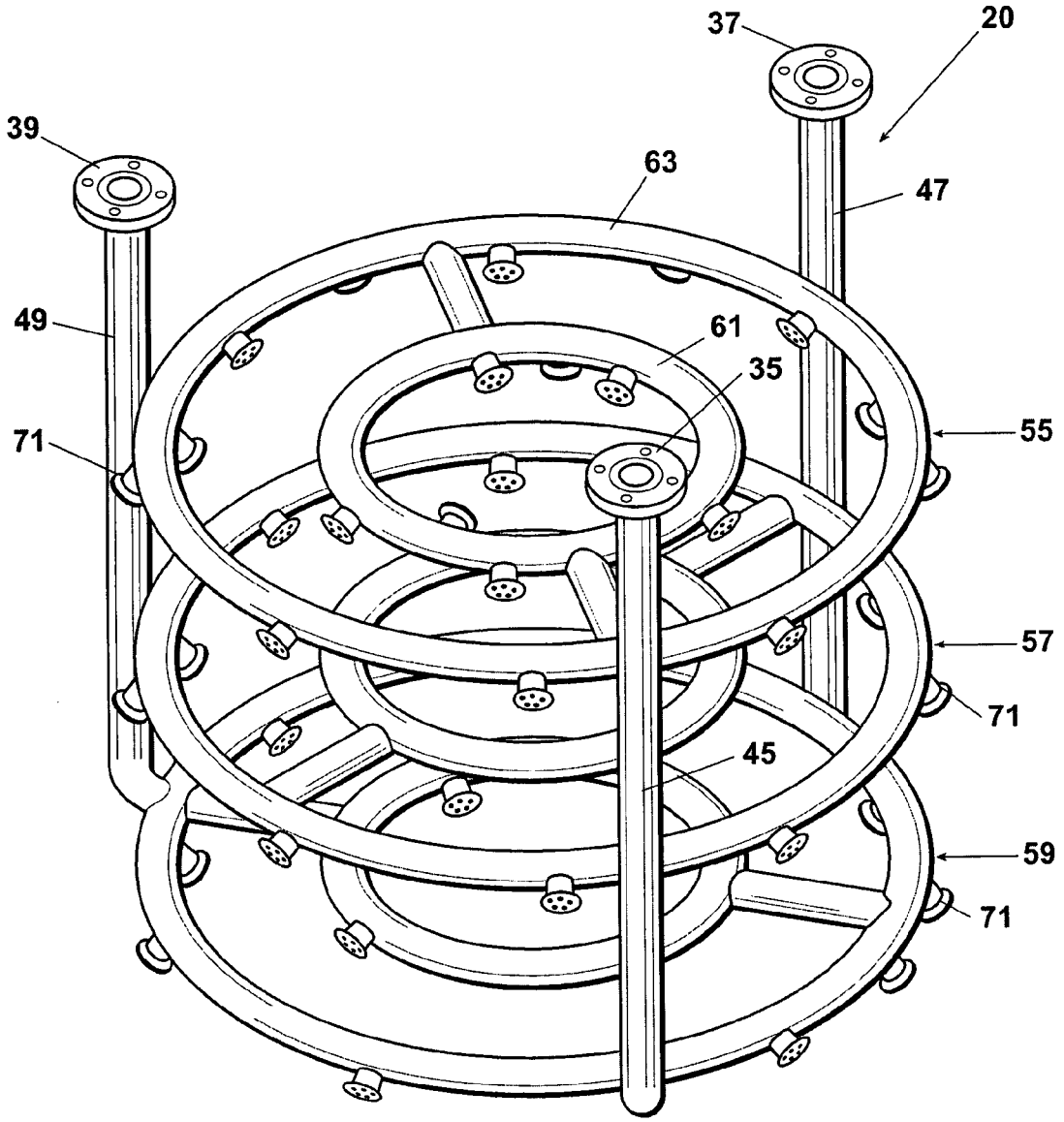
FIG. 7 is an isometric view of the nozzle spool of FIG. 4.

Referring to FIGS. 3A & B, a system and method for delivering dilution water within a crude oil stream includes a mixing vessel 10 with at least one spray nozzle 11 located within an interior space "S" of the vessel 10. The crude oil stream typically is an oil-dominant stream.

The spray nozzle 11 is arranged so that a centerline 13 of a spray pattern 15 of the dilution water droplets being delivered by the spray nozzle 11 is parallel to the longitudinal centerline 17 of the mixing vessel 10 (i.e., in a direction of flow "F" of the crude oil stream flowing through the mixing vessel 10). Therefore, the spray from each nozzle 11 is in a generally downward direction and into the downward flow F of the crude oil stream.

Mixing vessel 10 is a vertically oriented pipe located upstream of a mixing valve (not shown) and electrostatic dehydration process (also not shown). The spray nozzle 11 is plumbed to a horizontally oriented inlet pipe 19 which is in communication with a dilution water source (not shown). The spray nozzles 11 atomize the wash water from the dilution water source into the crude oil.

The spray nozzle 11 can be a first stage (or level) of spraying and at least one other spray nozzle 11 can be arranged downstream from and in an identical manner to the first-mentioned spray nozzle 11. The other spray nozzle 11 is a second stage (or level) of spraying. Multiple stages of spraying within the same mixing vessel 10 can be used as appropriate, as can multiple mixing vessels 10. Each stage within the vessel 10 preferably makes use of the same size of spray nozzle 11 and operates at the same pressures and rates. The number of spray nozzles 11 between inlet pipes 19 may be the same or vary as appropriate.

The pressure drop through each spray nozzle 11 is preferably in a range of 50 psi to 300 psi, and more preferably in a range of 80 to 120 psi.

The spray nozzles 11 preferably deliver dilution water droplets in the range of 10 to 300 microns in diameter and, more preferably, in the range of 10 to 30 microns in diameter.

A preferred embodiment (FIG. 3A with a single nozzle) of the system was tested in a pilot unit and compared to similar tests run with a conventional disperser like a mix valve and a static mixer. The results show that, for the conventional mix valve and static mixer, the contact efficiency between the wash water droplets and the brine droplets contained in the crude oil stream is in the range of 40 to 50%. The contact efficiency for the system and method described above is in the range of 60 to 70%.

If the spray nozzle 11 is located upstream of a conventional disperser like a mix valve, the contact efficiency increases to 90%. Therefore, the spray nozzle 11 can be used along with a conventional mix valve, static mixer, or both to improve significantly improve contact efficiency (see e.g. FIG. 8 for an example commercial installation 5).

Figure 9:
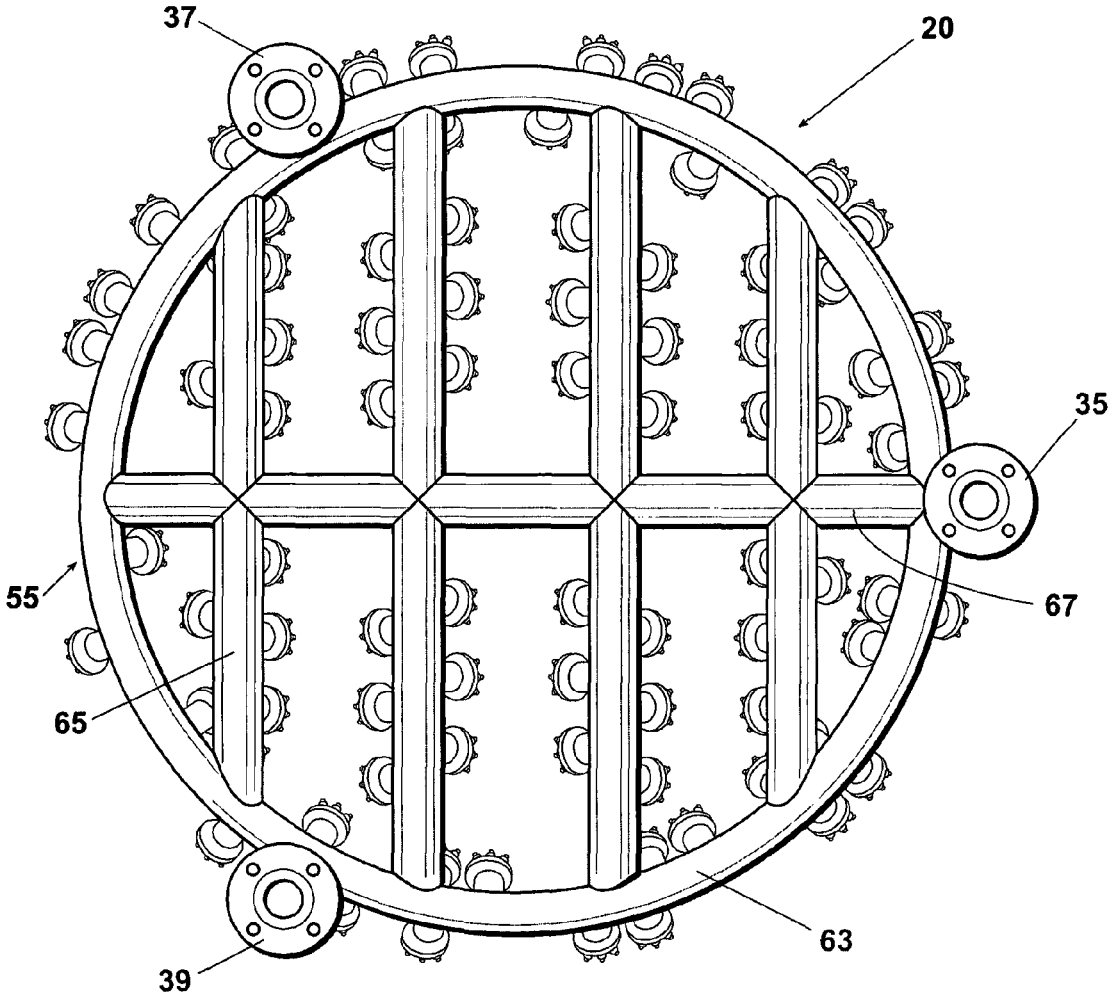
FIG. 9 is top view of an alternate embodiment of the nozzle spool. The ring-shaped levels are replaced by a cross-bar shaped level.

Referring now to FIGS. 4-7, an alternate embodiment of mixing vessel 10 includes a multi-level "nozzle spool" 20 having concentric inner and outer circular pipes or rings 61, 63 on each level 55, 57, 59 of the spool 20. Other piping arrangements can include other shapes preferable, such as but not limited to a cross-bar shaped arrangement like that shown in FIG. 9 in which lateral pipes 65 extend from a central longitudinal pipe 67 connected to a ring 63 and its respective wash water inlet 35, 37, or 39 (e.g., inlet 35 for first level 55). The spool 20 may also be a single level spool.

Each level 55, 57, 59 is connected to three vertical pipes 45, 47, and 49, with one vertical pipe 45, 47 or 49 providing wash water to the level 55, 57, 59 and that level's rings 61, 63. Each ring 61, 63 supports a plurality of spraying heads or manifolds 71, each manifold 71 having a plurality of spray nozzles 21. Preferably, the first or top level 55 has 45% of the total spray nozzles 21, the second or middle level 57 has 30% of the total nozzles 21, and the third or bottom level 59 has 25% of the total nozzles 21.

Figure 8:
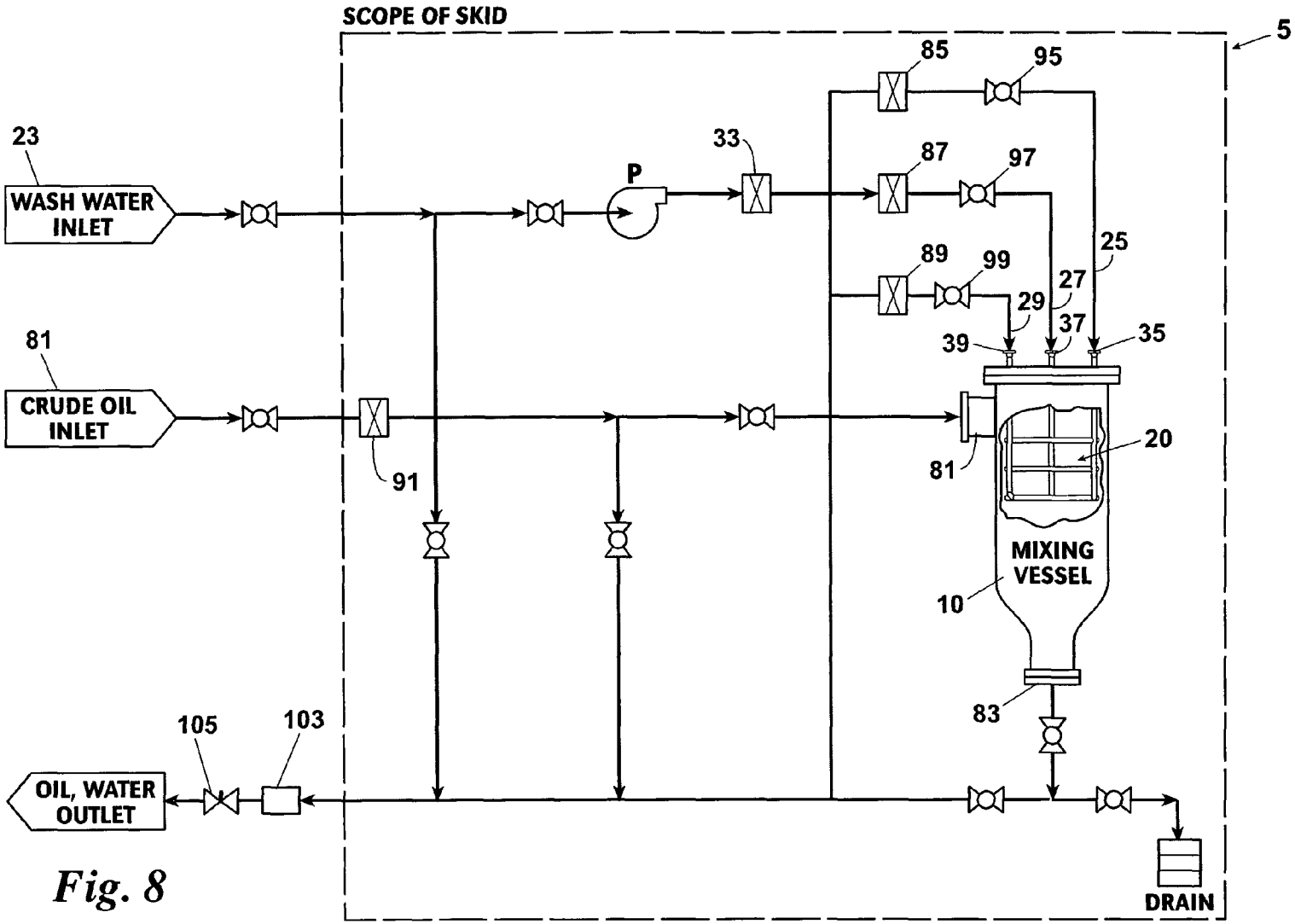
FIG. 8 is a schematic of a preferred embodiment of a system and method which makes use of a mixing vessel that houses the nozzle spool of FIG. 4.

Referring now to FIG. 8, the mixing vessel 10 has five ports: a crude oil inlet 81, three wash water inlets, 35, 37, 39, and a mixture outlet 83. Note that vessel 10 may have an internal pipe structure or arrangement other than that of nozzle spool 20 as shown in FIGS. 4-9. A positive displacement or centrifugal pump P pumps the wash water stream to the vessel 10 and guarantees the necessary working pressure for the spray nozzles 21. A flow meter 33 monitors the wash water stream.

Before entering the vessel 10, the wash water stream is divided into three sub-streams 25, 27, and 29 to allow a reasonable system turndown ratio. The sub-streams 25, 27 and 29 provide a wash water sub-stream to a respective vertical piping 45, 47 or 49 connected to the top, middle, or bottom level 55, 57, 59 (and the level's respective rings 61,63) of the nozzle spool 20.

Each inlet stream or piping 25, 27, 29 is equipped with a respective flow meter 85, 87, 89 and an on-off valve 95, 97, 99. The flow meter 85, 87, 89 monitors the sub-stream line 35, 37, 39 for plugged or leaking spray nozzles 21. The on-off valve 95, 97, 99 is used to direct the flow to each ring 61, 63 on the respective level 55, 57, 59 to maintain the pressure drop through the nozzles 21.

Similar to spray nozzle 11, spray nozzles 21 atomize the wash water from the dilution water source into the crude oil stream. The pressure drop through each spray nozzle 21 is preferably in a range of 50 psi to 300 psi, and more preferably in a range of 80 to 120 psi. The spray nozzles 21 preferably deliver dilution water droplets in the range of 10 to 300 microns in diameter and, more preferably, in the range of 10 to 30 microns in diameter. The spray from each nozzle 21 is in a general downward direction and into the crude oil flow as it flows in a downward direction through the vessel 10.

A crude oil stream enters the system through a crude oil inlet 81. The crude oil flow rate is monitored by a flow meter 91. The mixing vessel 10 could be bypassed when necessary to route the crude oil flow to static mixer 103 and mixing valve 105.

Vessel 10, when in use, represents the washing step located upstream of a separator vessel such as an electrostatic dehydration unit. The vessel 10 may replace the typical washing step described in the Background section or may be used in combination with it (see e.g., FIG. 8). One or more vessel 10's may be used prior to the mixed oil-and-water stream being routed to downstream equipment such as dehydrator or desalter vessel.

The preferred embodiments of the system and method described above are not all of the possible embodiments of the invention. The scope of the invention is defined by the following claims, including elements or steps which are equivalent to those recited.

What is claimed:

1. A system for use in a crude oil desalting operation, the system including an elongated vertically oriented vessel having a crude oil inlet located toward the top end of the vessel, an oil-and-water outlet located at the bottom end of the vessel, and at least one wash water inlet located toward a top end of the vessel, the system comprising:

a piping arrangement located within an interior space of the vessel and arranged concentric to the vessel, the piping arrangement having a plurality of spray nozzles angled toward the bottom end of the vessel and arranged to receive wash water from the at least one wash water inlet and atomize the wash water into a crude oil flow flowing within the vessel.

2. A system according to claim 1 wherein the piping arrangement includes two or more levels of piping.

3. A system according to claim 2 wherein one level of the piping arrangement is connected to the at least one wash water inlet and another level is connected to a different wash water inlet of the vessel.

4. A system according to claim 2 wherein the number of spray nozzles in the plurality of spray nozzles differs between the two or more levels of piping.

5. A system according to claim 1 wherein each spray nozzle in the plurality of spray nozzles delivers a dilution water droplet in a range of 10 to 300 microns in diameter.

6. A system according to claim 1 wherein a pressure drop through each spray nozzle in the plurality of spray nozzles is in a range of 50 to 300 psi.

7. A system according to claim 1 further comprising at least one of a mixing valve and a static mixer located downstream of the vessel.

8. A method of desalting a crude oil stream, the method comprising the steps of:

routing a crude oil stream into an elongated vertically oriented vessel, the vessel having an oil inlet located toward the top end of the vessel, an oil-and-water outlet located at the bottom end of the vessel, and at least one wash water inlet located toward the top end of the vessel;

routing a wash water stream into a piping arrangement located within an interior space of the vessel and arranged concentric to the vessel, the piping arrangement having a plurality of spray nozzles angled toward the bottom end of the vessel and arranged to receive wash water from the at least one wash water inlet.

spraying the wash water stream through the plurality of spray nozzles and into the crude oil stream.

9. A method according to claim 8 wherein the piping arrangement includes two or more levels of piping.

10. A method according to claim 9 wherein one level of the piping arrangement is connected to the at least one wash water inlet and another level is connected to a different wash water inlet of the vessel.

11. A method according to claim 9 wherein the number of spray nozzles in the plurality of spray nozzles differs between the two or more levels of piping.

12. A method according to claim 8 wherein each spray nozzle in the plurality of spray nozzles delivers a dilution water droplet in a range of 10 to 300 microns in diameter.

13. A method according to claim 8 wherein a pressure drop through each spray nozzle in the plurality of spray nozzles is in a range of 50 to 300 psi.

14. A method according to claim 8 further comprising at least one of a mixing valve and a static mixer located downstream of the vessel.

15. A vessel for desalting a crude oil stream, the vessel being an elongated vertically oriented vessel having an oil inlet located toward the top end of the vessel, an oil-and-water outlet located at the bottom end of the vessel, and at least two wash water inlets located toward the top end of the vessel, the vessel further comprising:

a multi-level piping structure located within an interior space of the vessel and arranged concentric to the vessel, each level of the piping structure having a plurality of spray nozzles angled toward the bottom end of the vessel and arranged to receive wash water from one of the at least two wash water inlets connected to the level and atomize the wash water into a crude oil stream flowing downwardly through the vessel.

* * * * *